US010920953B1

(12) United States Patent
Hatanaka

(10) Patent No.: US 10,920,953 B1
(45) Date of Patent: Feb. 16, 2021

(54) VEHICLE LUMINAIRE AND VEHICLE LAMP

(71) Applicant: Toshiba Lighting & Technology Corporation, Yokosuka (JP)

(72) Inventor: Toshihiro Hatanaka, Ehime-ken (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 0 days.

(21) Appl. No.: 17/010,360

(22) Filed: Sep. 2, 2020

(30) Foreign Application Priority Data

Nov. 22, 2019 (JP) ..... JP2019-211408

(51) Int. Cl.
*F21S 43/19* (2018.01)
*F21S 45/48* (2018.01)
*F21S 43/14* (2018.01)
*F21Y 115/10* (2016.01)

(52) U.S. Cl.
CPC ..... *F21S 43/195* (2018.01); *F21S 43/14* (2018.01); *F21S 45/48* (2018.01); *F21Y 2115/10* (2016.08)

(58) Field of Classification Search
CPC ..... F21S 43/195; F21S 43/14; F21S 43/48
USPC ..... 362/459
See application file for complete search history.

(56) References Cited

U.S. PATENT DOCUMENTS 10,203,080 B1 * 2/2019 Ishiyama ..... F21S 41/141
10,359,179 B2 * 7/2019 Ozawa ..... F21S 45/48
10,591,127 B2 * 3/2020 Shiraishi ..... F21V 29/74
10,724,698 B2 * 7/2020 Ano ..... F21S 45/48
10,781,993 B2 * 9/2020 Kosugi ..... F21S 43/195
10,845,018 B1 * 11/2020 Ueno ..... F21S 41/25
2015/0016136 A1 * 1/2015 Nakano ..... F21S 43/195 362/520
2016/0290621 A1 * 10/2016 Ozawa ..... F21S 43/14
2017/0097136 A1 * 4/2017 Hino ..... F21S 43/14
2017/0146213 A1 * 5/2017 Kosugi ..... F21S 43/14
2017/0343180 A1 * 11/2017 Ishiyama ..... F21S 45/48
2018/0100643 A1 * 4/2018 Hino ..... F21S 45/48
2018/0106448 A1 * 4/2018 Shiraishi ..... B60Q 1/0088

FOREIGN PATENT DOCUMENTS

JP 2013-247061 A 12/2013

* cited by examiner

*Primary Examiner* — Bryon T Gyllstrom
(74) *Attorney, Agent, or Firm* — Banner & Witcoff, Ltd.

(57) ABSTRACT

A vehicle luminaire according to an embodiment includes: a substrate is provided on a heat transfer portion or a convex portion; at least one light-emitting element is provided on the substrate; a first adhesive layer is provided between the substrate and the heat transfer portion or between the substrate and the convex portion. An area on the side of the substrate in the heat transfer portion or an area on the side of the substrate in the convex portion is provided with a center area and a peripheral edge area. A distance between the substrate and an end on the side opposite to the center area in a corresponding portion in at least a part of the peripheral edge area is larger than a distance between the substrate and an end on the side of the center area in the corresponding portion.

20 Claims, 7 Drawing Sheets

VEHICLE LUMINAIRE AND VEHICLE LAMP

CROSS-REFERENCE TO RELATED APPLICATIONS

This application is based upon and claims the benefit of priority from Japanese Patent Application No. 2019-211408, filed on Nov. 22, 2019; the entire contents of which are incorporated herein by reference.

FIELD

Embodiments described herein relate to a vehicle luminaire and a vehicle lamp.

BACKGROUND

From the viewpoint of energy saving and long life, a vehicle luminaire having a light-emitting diode has been widely used instead of a vehicle luminaire having a filament.

In general, the light-emitting diode is mounted on a substrate and the substrate provided with the light-emitting diode is bonded to one end of a socket.

Further, when a voltage is applied to the light-emitting diode, light is emitted from the light-emitting diode, but heat is also generated therefrom. Therefore, the temperature of the light-emitting diode rises due to the generated heat. In this case, when the temperature of the light-emitting diode is too high, there is a risk that the function of the light-emitting diode may be deteriorated or the life of the light-emitting diode may be shortened. Therefore, a plate-shaped heat transfer portion is provided between the socket and the substrate provided with the light-emitting diode. When the heat transfer portion is provided, the substrate provided with the light-emitting diode is bonded to a surface on the side opposite to the socket in the heat transfer portion.

Here, when the substrate provided with the light-emitting diode is bonded to the heat transfer portion or the socket, an adhesive may enter the vicinity of a peripheral edge of a surface provided with the light-emitting diode in the substrate in some cases. A surface provide with the light-emitting diode in the substrate is easily visible. Therefore, when the adhesive is bonded to the vicinity of the peripheral edge of the substrate, there is concern that a product value may be degraded due to a poor appearance. Further, the adhesive for bonding the substrate provided with the light-emitting diode to the heat transfer portion or the socket is preferably an adhesive having high thermal conductivity, but the adhesive having high thermal conductivity may be conductive. When the conductive adhesive is bonded to the vicinity of the peripheral edge of the substrate, there is concern that a short circuit may occur.

Here, it has been desired to develop a technique capable of suppressing an adhesive from being bonded to the vicinity of a peripheral edge of a substrate.

DETAILED DESCRIPTION

Figure 1:
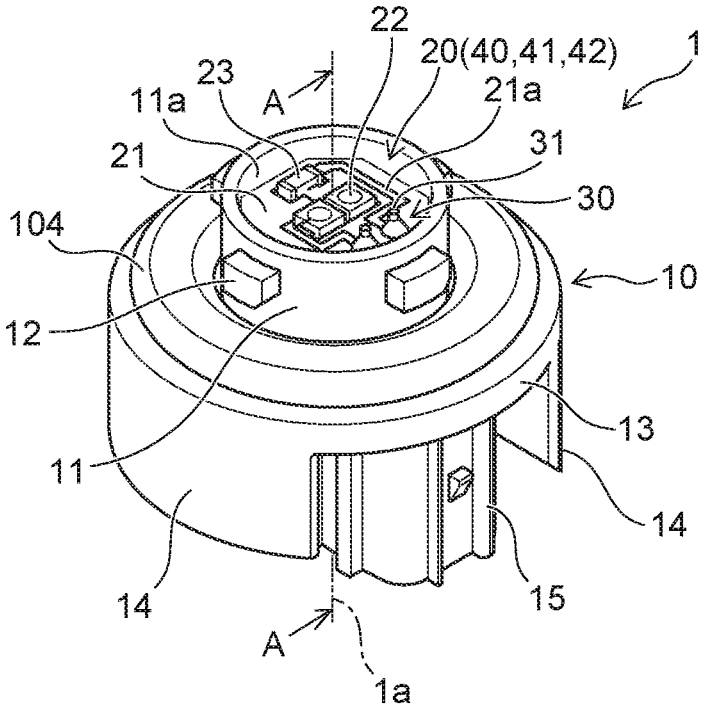
FIG. 1 is a schematic perspective view illustrating a vehicle luminaire according to an embodiment.

A vehicle luminaire according to an embodiment includes: a socket; a heat transfer portion or a convex portion which is provided at one end side of the socket; a substrate which is provided on the heat transfer portion or the convex portion; at least one light-emitting element which is provided on the side opposite to the heat transfer portion in the substrate or on the side opposite to the convex portion in the substrate; and a first adhesive layer which is provided between the substrate and the heat transfer portion or between the substrate and the convex portion. An area on the side of the substrate in the heat transfer portion or an area on the side of the substrate in the convex portion is provided with a center area and a peripheral edge area provided on the outside of the center area. A distance between the substrate and an end on the side opposite to the center area in a corresponding portion in at least a part of the peripheral edge area is larger than a distance between the substrate and an end on the side of the center area in the corresponding portion.

Hereinafter, an embodiment will be illustrated with reference to the drawings. In the drawings, the same components are indicated by the same reference numerals and detailed description thereof will be appropriately omitted.

(Vehicle Luminaire)

A vehicle luminaire 1 according to an embodiment can be provided in, for example, automobiles and rail cars. Examples of the vehicle luminaire 1 provided in automobiles include, for example, a front combination light (for example, an appropriate combination of a daytime running lamp (DRL), a position lamp, a turn signal lamp, and the like), a rear combination light (for example, an appropriate combination of a stop lamp, a tail lamp, a turn signal lamp, a back lamp, a fog lamp, and the like), and the like. However, the application of the vehicle luminaire 1 is not limited to these.

FIG. 1 is a schematic perspective view illustrating the vehicle luminaire 1 according to the embodiment.

Figure 2:
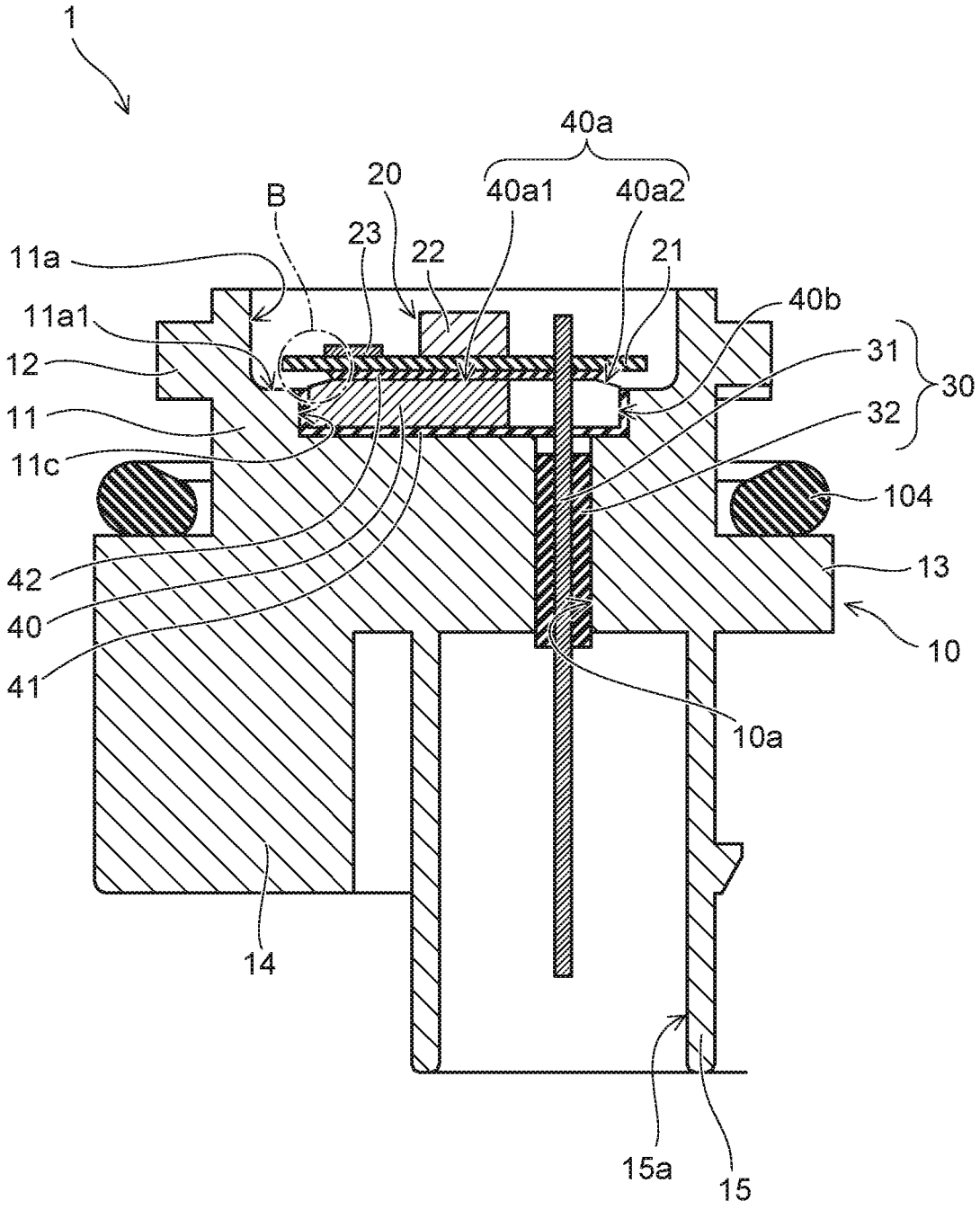
FIG. 2 is a cross-sectional view taken along a line A-A of the vehicle luminaire of FIG. 1.

FIG. 2 is a cross-sectional view taken along a line A-A of the vehicle luminaire 1 of FIG. 1.

Figure 3:
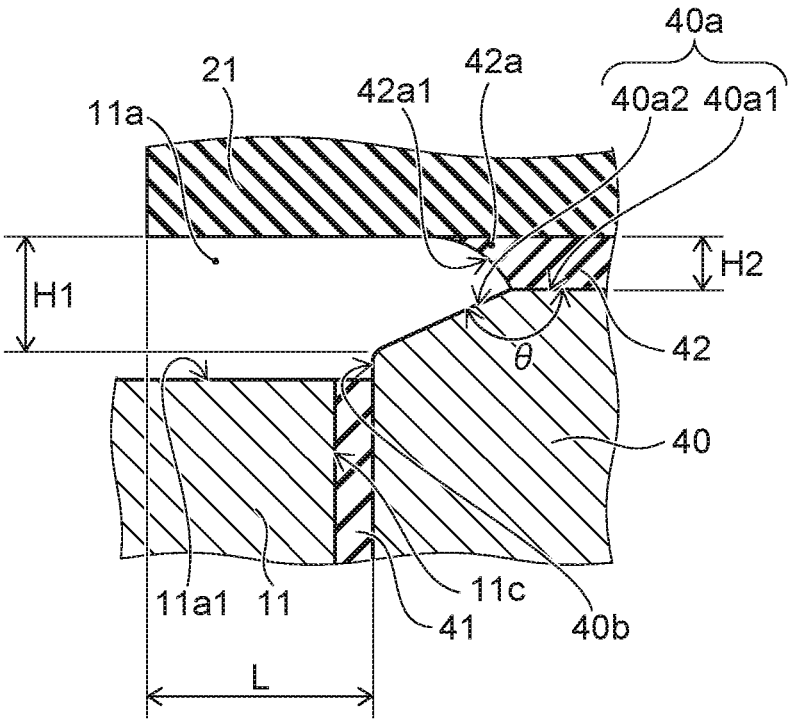
FIG. 3 is a schematic enlarged view of a B part of the vehicle luminaire of FIG. 2.

FIG. 3 is a schematic enlarged view of a B part of the vehicle luminaire 1 of FIG. 2.

As shown in FIGS. 1 and 2, the vehicle luminaire 1 can be provided with a socket 10, a light-emitting module 20, a power-supply unit 30, and a heat transfer portion 40.

The socket 10 can include a mounting portion 11, a bayonet 12, a flange 13, a radiating fin 14, and a connector holder 15.

The mounting portion 11 can be provided on a surface opposite to the installation side of the radiating fin 14 in the flange 13. The outer shape of the mounting portion 11 can be a pillar shape. The outer shape of the mounting portion 11 is, for example, a columnar shape. The mounting portion 11 can include a concave portion 11*a* opening to an end opposite to the flange 13.

Further, a concave portion 11*c* which opens to a bottom surface 11*a*1 of the concave portion 11*a* can be provided. A heat transfer portion 40 can be provided inside the concave portion 11*c*.

The bayonet 12 can be provided on the outer surface of the mounting portion 11. For example, the bayonet 12 protrudes toward the outside of the vehicle luminaire 1. The bayonet 12 can face the flange 13. A plurality of the bayonets 12 can be provided. The bayonet 12 can be used when mounting the vehicle luminaire 1 to a housing 101 of a vehicle lamp 100. The bayonet 12 can be used for a twist lock.

The flange 13 can have a plate shape. For example, the flange 13 can have a disk shape. The outer surface of the flange 13 can be located on the outside of the vehicle luminaire 1 in relation to the outer surface of the bayonet 12.

The radiating fin 14 can be provided on the side opposite to the mounting portion 11 in the flange 13. At least one radiating fin 14 can be provided. For example, the socket 10 illustrated in FIG. 1 is provided with a plurality of the radiating fins 14. The plurality of radiating fins 14 can be provided side by side in a predetermined direction. The radiating fin 14 can have a plate shape.

The connector holder 15 can be provided on the side opposite to the mounting portion 11 in the flange 13. The connector holder 15 can be provided between the radiating fin 14 and the radiating fin 14. The connector holder 15 can be provided in the vicinity of the peripheral edge of the flange 13.

A connector 105 is insertable into the connector holder 15. The connector holder 15 can have a cylindrical shape and have a hole 15*a* formed therein. The connector 105 having a seal member 105*a* can be inserted into the hole 15*a*. For that reason, the cross-sectional shape and the cross-sectional dimension of the hole 15*a* are suitable for the cross-sectional shape and the cross-sectional dimension of the connector 105 having the seal member 105*a*.

The socket 10 can have a function of holding the light-emitting module 20, the power-supply unit 30, and the heat transfer portion 40 and a function of transferring heat generated in the light-emitting module 20 to the outside. Therefore the socket 10 is preferably formed of a material having high thermal conductivity.

Further, in recent years, it is preferable that the socket 10 can efficiently radiate heat generated in the light-emitting module 20 and have light weight. Therefore, it is more preferable that the socket 10 be formed of a high thermal conductive resin. The high thermal conductive resin includes, for example, a resin and a filler using an inorganic material. For example, the high thermal conductive resin can be obtained by mixing a filler using carbon or aluminum oxide with a resin such as polyethylene terephthalate (PET) or nylon.

According to the socket 10 which is integrally formed with the mounting portion 11, the bayonet 12, the flange 13, the radiating fin 14, and the connector holder 15 by including a high thermal conductive resin, heat generated in the light-emitting module 20 can be efficiently radiated. Further, the socket 10 can have a light weight. In this case, the mounting portion 11, the bayonet 12, the flange 13, the radiating fin 14, and the connector holder 15 can be integrally molded by using an injection-molding method or the like. Further, the socket 10 and the power-supply unit 30 can be integrally molded by using an insert-molding method or the like.

The light-emitting module 20 can include a substrate 21, a light-emitting element 22, and a resistor 23.

The light-emitting module 20 (the substrate 21) can be provided on the heat transfer portion 40. As will be described later, the light-emitting module 20 (the substrate 21) can be bonded to an area 40*a* on the side of the substrate 21 in the heat transfer portion 40. A layer formed by curing an adhesive becomes an adhesive layer 42. Heat generated in the light-emitting module 20 is transferred to the heat transfer portion 40 through the substrate 21 and the adhesive layer 42.

Therefore, the adhesive for bonding the substrate 21 is preferably an adhesive having high thermal conductivity. For example, the adhesive can be an adhesive mixed with a filler using a material having high thermal conductivity. The material having high thermal conductivity can be, for example, carbon, ceramics such as aluminum oxide, or metal. The thermal conductivity of the adhesive can be, for example, 0.5 W/(m·K) or more and 10 W/(m·K) or less. The adhesive layer 42 formed by curing such an adhesive includes a resin and a filler. Further, the thermal conductivity of the adhesive layer 42 can be, for example, 0.5 W/(m·K) or more and 10 W/(m·K) or less. When the adhesive layer 42 having such thermal conductivity is provided between the heat transfer portion 40 and the substrate 21, heat generated in the light-emitting module 20 is easily transferred to the heat transfer portion 40 through the adhesive layer 42.

The substrate 21 can have a plate shape. The planar shape of the substrate 21 can be, for example, a square shape. The substrate 21 can be formed of, for example, an inorganic material such as ceramics (for example, aluminum oxide or aluminum nitride) or an organic material such as paper phenol or glass epoxy. Further, the substrate 21 can be a metal substrate of which a surface is coated with an insulating material. Additionally, when the surface of the metal substrate is coated with an insulating material, the insulating material may include an organic material or an inorganic material. When the heat generation amount of the light-emitting element 22 is large, the substrate 21 is preferably formed of a material having high thermal conductivity from the viewpoint of thermal radiation. Examples of the material having high thermal conductivity include ceramics such as aluminum oxide and aluminum nitride, a high thermal conductive resin, and a metal substrate whose surface is coated with an insulating material.

Further, a surface of the substrate 21 can be provided with a wiring pattern 21*a*. The wiring pattern 21*a* can be formed of, for example, a material including silver as a main component or a material including copper as a main component. Further, the substrate 21 may have a single-layer structure or a multi-layer structure.

The light-emitting element 22 can be provided on the side opposite to the heat transfer portion 40 in the substrate 21. At least one light-emitting element 22 can be provided. In the case of the vehicle luminaire 1 illustrated in FIG. 1, a plurality of the light-emitting elements 22 are provided. Additionally, when the plurality of light-emitting elements 22 are provided, the plurality of light-emitting elements 22 can be connected in series to each other. Further, the light-emitting element 22 can be connected in series to the resistor 23.

The light-emitting element 22 can be, for example, a light-emitting diode, an organic light-emitting diode, a laser diode, or the like.

The light-emitting element 22 can be, for example, a surface mount type light-emitting element such as a plastic leaded chip carrier (PLCC) type. Further, the light-emitting element 22 can be, for example, a shell type light-emitting element with a lead wire. Additionally, the light-emitting element 22 illustrated in FIG. 1 is a surface mount type light-emitting element.

Further, the light-emitting element 22 can be mounted by chip on board (COB). In the case of the light-emitting element 22 mounted by COB, the chip-like light-emitting element 22, a wiring electrically connecting the light-emitting element 22 and the wiring pattern 21*a*, a frame-shaped member surrounding the light-emitting element 22 and the wiring, a sealing portion provided inside the frame-shaped member, and the like can be provided on the substrate 21. In this case, the frame-shaped member can have a function of defining the formation range of the sealing portion and a function of a reflector. Further, the sealing portion can have a phosphor. The phosphor can be, for example, a YAG-based phosphor (yttrium-aluminum-garnet-based phosphor) or the like. Additionally, only the sealing portion can be provided without the frame-shaped member. When only the sealing portion is provided, the dome-shaped sealing portion is provided on the substrate 21.

The light-emitting surface of the light-emitting element 22 is directed to the front side of the vehicle luminaire 1. The light-emitting element 22 mainly emits light toward the front side of the vehicle luminaire 1. The number, size, arrangement, and the like of the light-emitting elements 22 are not limited to those illustrated, but can be changed as appropriate according to the size and application of the vehicle luminaire 1.

The resistor 23 can be provided on the side opposite to the heat transfer portion 40 in the substrate 21. The resistor 23 can be electrically connected to the wiring pattern 21*a*. The resistor 23 can be, for example, a surface mount type resistor, a resistor having a lead wire (a metal oxide film resistor), a film resistor formed by using a screen printing method, or the like. Additionally, the resistor 23 illustrated in FIG. 1 is a surface mount type resistor.

The material of the film resistor can be, for example, ruthenium oxide ($RuO_2$). The film resistor can be formed by using, for example, a screen printing method and a firing method. When the resistor 23 is a film resistor, a contact area between the resistor 23 and the substrate 21 can be increased and hence the thermal radiating performance can be improved. Further, the plurality of resistors 23 can be formed at one time. Therefore, the productivity can be improved. Further, a variation in the resistance value of the plurality of resistor 23 can be suppressed.

Here, since the forward voltage characteristics of the light-emitting element 22 vary, the brightness of the light emitted from the light-emitting element 22 (light flux, brightness, luminous intensity, illuminance) varies when the voltage applied across the anode terminal and the ground terminal is constant. Therefore, the value of the current flowing through the light-emitting element 22 can be set within a predetermined range so that the brightness of the light emitted from the light-emitting element 22 falls within a predetermined range. In this case, the value of the current flowing through the light-emitting element 22 can be set within a predetermined range by changing the resistance value of the resistor 23.

When the resistor 23 is a surface mount type resistor or a resistor with a lead wire, the resistor 23 having an appropriate resistance value can be selected in response to the forward voltage characteristics of the light-emitting element 22. When the resistor 23 is a film resistor, the resistance value can be increased if a part of the resistor 23 is removed. The number, size, arrangement, and the like of the resistors 23 are not limited to those illustrated and can be appropriately changed according to the number, specifications, and the like of the light-emitting elements 22.

Further, other electric components can be appropriately provided. For example, a diode can be provided to suppress a reverse voltage from being applied to the light-emitting element 22 and to suppress pulse noise from the reverse direction from being applied to the light-emitting element 22. Further, a pull-down resistor can be provided to detect the conduction of the light-emitting element 22 and suppress erroneous lighting. Further, the capacitor or semiconductor element can be appropriately provided.

Further, it is possible to provide a covering portion that covers the wiring pattern 21*a*, the film-like resistor, and the like. The covering portion can include, for example, a glass material.

Further, the resistor 23 or other electric components (diodes, pull-down resistors, capacitors, semiconductor elements, and the like) are heat generating members. Therefore, as will be described later, the resistor 23 or other electric components are preferably disposed in an area on the substrate 21 where the substrate 21 overlaps a center area 40*a*1 of the heat transfer portion 40 in plan view. Accordingly, heat generated in the resistor 23 or other electric components is easily transferred to the socket 10.

The power-supply unit 30 can include a power-supply terminal 31 and a holder 32.

The power-supply terminal 31 can have a bar shape. The power-supply terminal 31 can protrude from the bottom surface 11*a*1 of the concave portion 11*a*. A plurality of the power-supply terminals 31 can be provided. The plurality of power-supply terminals 31 can be provided side by side in a predetermined direction. The plurality of power-supply terminals 31 extend inside the holder 32. The ends on the side of the light-emitting module 20 in the plurality of power-supply terminals 31 can be soldered to the wiring pattern 21*a* provided in the substrate 21. The ends on the side of the radiating fin 14 in the plurality of power-supply terminals 31 can be exposed inside the hole 15*a* of the connector holder 15. The connector 105 can be fitted to the plurality of power-supply terminals 31 exposed inside the hole 15*a*. The power-supply terminal 31 can be formed of, for example, metal such as copper alloy. Additionally, the number, shape, arrangement, material, and the like of the power-supply terminals 31 are not limited to those illustrated, but can be changed as appropriate.

As described above, the socket 10 is preferably formed of a material having high thermal conductivity. Incidentally, a material having high thermal conductivity may have conductivity in some cases. For example, a high thermal conductive resin using a filler including carbon has conductivity. Therefore, the holder 32 can be provided to insulate the power-supply terminal 31 and the conductive socket 10 from each other. Further, the holder 32 can also have a function of holding the plurality of power-supply terminals 31. Additionally, when the socket 10 is formed of a high thermal conductive resin having an insulating property (for example, a high thermal conductive resin using a filler including aluminum oxide), the holder 32 can be omitted. In this case, the socket 10 can hold the plurality of power-supply terminals 31.

The holder 32 can be formed of a resin having an insulating property. For example, the holder 32 can be press-inserted into the hole 10*a* provided in the socket 10 or attached to the inner wall of the hole 10*a*.

The heat transfer portion 40 can be provided at one end side of the socket 10. The heat transfer portion 40 is provided to easily transfer heat generated in the light-emitting module 20 to the socket 10. Therefore, the heat transfer portion 40 is preferably formed of a material having high thermal conductivity. For example, the heat transfer portion 40 can be formed of metal such as aluminum, aluminum alloy, copper, or copper alloy.

In the case of the vehicle luminaire 1 provided in an automobile, the use environment temperature is −40° C. to 85° C. Therefore, when the heat generation amount of the light-emitting element 22 is too large, the temperature of the light-emitting element 22 becomes too high. Accordingly, there is a risk that the life of the light-emitting element 22 may be shortened or the function of the light-emitting element 22 may be deteriorated.

As described above, the socket 10 and the heat transfer portion 40 are formed of a material having high thermal conductivity. Therefore, it is possible to suppress the temperature of the light-emitting element 22 from becoming too high.

As shown in FIGS. 2 and 3, the heat transfer portion 40 can be provided inside the concave portion 11*c*. The heat transfer portion 40 can be bonded into the concave portion 11*c*. An adhesive for bonding the heat transfer portion 40 is preferably an adhesive having high thermal conductivity. The adhesive for bonding the heat transfer portion 40 to the socket 10 can be the same as, for example, the adhesive for bonding the substrate 21 to the heat transfer portion 40.

A layer formed by curing such an adhesive becomes an adhesive layer 41. Therefore, the adhesive layer 41 includes a resin and a filler. Further, the thermal conductivity of the adhesive layer 41 can be, for example, 0.5 W/(m·K) or more and 10 W/(m·K) or less. When the adhesive layer 41 having such thermal conductivity is provided between the heat transfer portion 40 and the socket 10, heat generated in the light-emitting module 20 can be easily transferred to the socket 10 through the heat transfer portion 40 and the adhesive layer 41.

Additionally, the concave portion 11*c* can be omitted. When the concave portion 11*c* is omitted, the heat transfer portion 40 can be bonded to the bottom surface 11*a*1 of the concave portion 11*a*. However, when the heat transfer portion 40 is bonded into the concave portion 11*c*, the positional deviation of the heat transfer portion 40 with respect to the socket 10 can be suppressed. Further, the bonding strength between the heat transfer portion 40 and the socket 10 can be increased.

An area 40*a* on the side of the substrate 21 in the heat transfer portion 40 can include a center area 40*a*1 and a peripheral edge area 40*a*2.

The center area 40*a*1 can be an area including the center of the area 40*a*. The center area 40*a*1 can include a flat surface. The flat surface included in the center area 40*a*1 can be a surface substantially orthogonal to a center axis 1*a* of the vehicle luminaire 1 (the socket 10). The flat surface can be a surface substantially parallel to the surface on the side of the heat transfer portion 40 in the substrate 21. Additionally, the flat surface of the center area 40*a*1 may be provided with a fine unevenness. The center area 40*a*1 can be provided with at least one of the flat surface, the concave portion, and the convex portion. When the flat surface and the concave portion are provided, the bonding strength between the adhesive layer 42 and the heat transfer portion 40 and further the bonding strength between the substrate 21 and the heat transfer portion 40 can be increased. When the flat surface and the convex portion are provided, a distance between the heat transfer portion 40 and the substrate 21 can be easily set within a predetermined range. Therefore, since the thickness of the adhesive layer 42 is substantially constant, it is possible to suppress a variation in the bonding strength between the heat transfer portion 40 and the substrate 21.

The center area 40*a*1 can be provided at a position protruding from the bottom surface 11*a*1 of the concave portion 11*a*. That is, the center area 40*a*1 can be provided at a position protruding from the surface (the bottom surface 11*a*1) where the concave portion 11*c* opens in the socket 10. The light-emitting module 20 (the substrate 21) can be bonded to the center area 40*a*1. Therefore, the adhesive layer 42 is provided between the substrate 21 and the heat transfer portion 40.

The peripheral edge area 40*a*2 is provided on the outside of the center area 40*a*1. The peripheral edge area 40*a*2 can be a frame-shaped area surrounding the center area 40*a*1. An inclined surface can be provided in at least a part of the peripheral edge area 40*a*2. That is, the peripheral edge area 40*a*2 can include the inclined surface. For example, the inclined surface can be provided in the entire area along the peripheral edge of the heat transfer portion 40 or be provided in a part of the area.

The inclined surface included in the peripheral edge area 40*a*2 can be a surface which is inclined with respect to the center axis 1*a* of the vehicle luminaire 1 (the socket 10). The inclined surface can be a surface which is inclined with respect to the surface on the side of the heat transfer portion 40 in the substrate 21. A distance H1 between the substrate 21 and the end on the side opposite to the center area 40*a*1 (the side of a side surface 40*b* of the heat transfer portion 40) in a portion (an inclined surface) of at least a part of the peripheral edge area 40*a*2 is larger than a distance H2 between the substrate 21 and the end on the side of the center area 40*a*1 in a corresponding portion.

Further, a fillet 42*a* can be provided in the peripheral edge of the adhesive layer 42. The fillet 42*a* contacts at least a surface on the side of the heat transfer portion 40 in the substrate 21. A surface 42*a*1 exposed inside the concave portion 11*a* in the fillet 42*a* can be a concave curved surface.

When the fillet 42*a* is provided, the bonding strength between the substrate 21 and the adhesive layer 42 and further the bonding strength between the heat transfer portion 40 and the substrate 21 can be increased. Further, the peripheral edge portion of the film-like adhesive layer 42 is easily peeled off, but when the fillet 42*a* is provided, the bonding strength of the peripheral edge portion of the adhesive layer 42 can be increased. Therefore, it is possible to suppress the peripheral edge portion of the adhesive layer 42 from being peeled off.

Further, the fillet 42*a* can be provided in the entire circumference in a direction along the peripheral edge of the substrate 21 or be provided in a part of the area. In this case, when the length of the fillet 42*a* along the peripheral edge of the substrate 21 becomes long, the bonding strength between the heat transfer portion 40 and the substrate 21 can be increased.

Further, the surface roughness of the surface on the side of the heat transfer portion 40 in the substrate 21 is preferably 5 μm or more and 40 μm or less in terms of the arithmetic average roughness Ra. With such a configuration, since the bonding strength between the fillet 42*a* and the substrate 21 can be increased, the bonding strength between the heat transfer portion 40 and the substrate 21 is easily increased.

For example, the fillet 42*a* can be formed in such a manner that an adhesive is supplied onto the center area 40*a*1 and the light-emitting module 20 (the substrate 21) is pressed against the center area 40*a*1 so that the adhesive protrudes toward the outside of the center area 40*a*1.

For example, the fillet 42*a* can be formed by supplying an adhesive along the peripheral edge of the center area 40*a*1 using a dispenser or the like.

In this case, the shape of the fillet 42*a* can be formed by a surface tension or the like or be formed by a spatula or the like.

Here, when only the surface on the side of the substrate 21 in the heat transfer portion is a flat surface, there is a risk that the adhesive extruded toward the outside of the heat transfer portion when the light-emitting module 20 (the substrate 21) is bonded to the heat transfer portion may enter the vicinity of the peripheral edge of the surface provided with the light-emitting element 22 in the substrate 21. The surface provided with the light-emitting element 22 in the substrate 21 is easily visible. Therefore, when the adhesive is bonded to the vicinity of the peripheral edge of the substrate 21, there is a risk that a product value may be degraded due to a poor appearance.

Further, as described above, the adhesive for bonding the substrate 21 is preferably an adhesive having high thermal conductivity.

Incidentally, the adhesive having high thermal conductivity has conductivity. When the conductive adhesive is bonded to the vicinity of the peripheral edge of the substrate 21, there is a risk that a short-circuit or the like may occur.

Since the peripheral edge area 40*a*2 of the heat transfer portion 40 according to the embodiment includes the inclined surface, the adhesive extruded toward the outside of the center area 40*a*1 is easily guided toward the bottom surface 11*a*1 of the concave portion 11*a*. Further, since the distance between the inclined surface and the substrate 21 increases as it goes toward the outside of the peripheral edge area 40*a*2, the adhesive hardly enters the vicinity of the peripheral edge of the surface provided with the light-emitting element 22 in the substrate 21. Therefore, since the adhesive is bonded to the vicinity of the peripheral edge of the substrate 21, it is possible to suppress a degraded product value of the vehicle luminaire 1 or a short-circuit.

When the adhesive including a silicone resin and a filler to be described later is used, the viscosity of the adhesive is about 2 Pa·s to 80 Pa·s. Therefore, as shown in FIG. 3, an angle θ between the flat surface of the center area 40*a*1 and the inclined surface of the peripheral edge area 40*a*2 is preferably 135° or more and 179° or less. With such a configuration, the adhesive extruded toward the peripheral edge area 40*a*2 is easily guided toward the bottom surface 11*a*1 of the concave portion 11*a*. Therefore, the adhesive more hardly enters the vicinity of the peripheral edge of the surface provided with the light-emitting element 22 in the substrate 21. Further, when the angle θ is smaller than 135°, the amount of heat transferred from the heat transfer portion 40 to the socket 10 decreases. Therefore, the angle θ is preferably 135° or more and 179° or less.

Further, as shown in FIGS. 2 and 3, the peripheral edge of the substrate 21 is located on the outside of the peripheral edge of the heat transfer portion 40 in plan view. Therefore, the adhesive extruded toward the outside of the heat transfer portion 40 hardly enters the vicinity of the peripheral edge of the surface provided with the light-emitting element 22 in the substrate 21.

Further, when the peripheral edge of the substrate 21 protrudes from the side surface 40*b* of the heat transfer portion 40, a claw of a chuck for grasping the vicinity of the peripheral edge of the light-emitting module 20 (the substrate 21) can enter between the vicinity of the peripheral edge of the substrate 21 and the bottom surface 11*a*1 of the concave portion 11*a*. Therefore, the light-emitting module 20 (the substrate 21) is easily bonded to the heat transfer portion 40 after the module is placed thereon using a transfer device having a chuck.

Figure 4A:
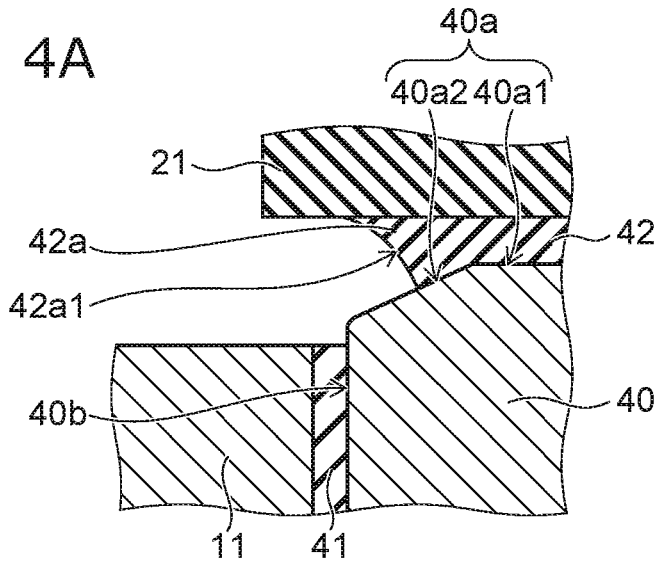
FIGS. 4A to 4C are schematic cross-sectional views illustrating an effect of an inclined surface provided in a peripheral edge area.
Figure 4B:
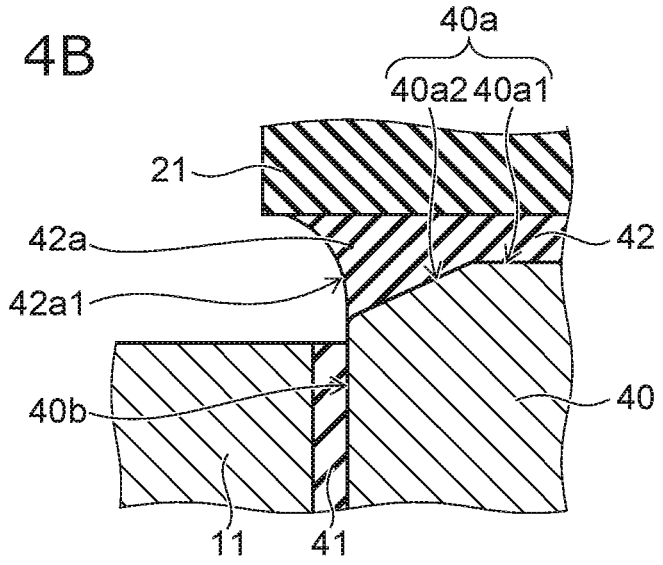
Figure 4C:
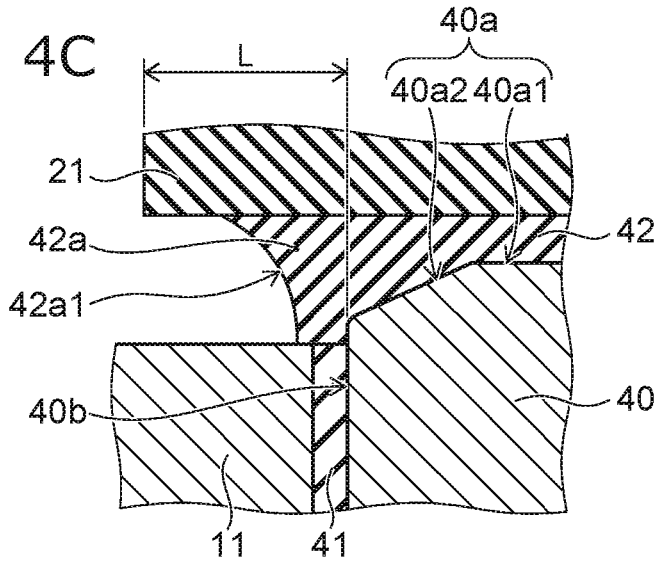

FIGS. 4A to 4C are schematic cross-sectional views illustrating an effect of the inclined surface provided in the peripheral edge area 40*a*2.

As shown in FIG. 4A, the peripheral edge of the adhesive layer 42 may be located on the inclined surface.

As shown in FIG. 4B, the adhesive layer 42 can also be provided to cover the inclined surface.

Therefore, it is possible to suppress the adhesive from being bonded to the vicinity of the peripheral edge of the substrate 21 even when the amount of the adhesive supplied onto the center area 40*a*1 varies.

Additionally, as shown in FIG. 3, the peripheral edge of the adhesive layer 42 may not exist on the inclined surface. However, when the peripheral edge of the adhesive layer 42 is located on the inclined surface, the bonding strength between the heat transfer portion 40 and the substrate 21 can be increased.

Further, as shown in FIG. 4C, when the distance L between the side surface 40*b* of the heat transfer portion 40 and the end face of the substrate 21 (the protrusion dimension of the substrate 21 from the heat transfer portion 40) in a direction orthogonal to the center axis 1*a* of the vehicle luminaire 1 is 0.3 mm or more and 3.0 mm or less, it is possible to suppress the adhesive from being bonded to the vicinity of the peripheral edge of the substrate 21 even when the peripheral edge of the adhesive layer 42 is located outside the heat transfer portion 40. In this case, the adhesive layer 41 and the adhesive layer 42 may be integrated with each other. When the adhesive layer 41 and the adhesive layer 42 are integrated with each other, the bonding strength between the heat transfer portion 40 and the socket 10 can be further increased. Further, although the peripheral edges of the adhesive layer 41 and the adhesive layer 42 having a film shape are easily peeled off, it is possible to suppress the peripheral edges of the adhesive layer 41 and the adhesive layer 42 from being peeled off when the adhesive layer 41 and the adhesive layer 42 are integrated with each other.

Further, the heat transfer portion 40 can also be provided inside the concave portion 11*c* or on the bottom surface 11*a*1 of the concave portion 11*a* through a layer including thermal conductive grease (thermal grease). The thermal conductive grease may be, for example, a mixture of modified silicone and a filler using a material having high thermal conductivity. The material having high thermal conductivity can be, for example, carbon, ceramics such as aluminum oxide, or metal. The thermal conductivity of the thermal conductive grease can be, for example, 1 W/(m·K) or more and 5 W/(m·K) or less.

Further, the heat transfer portion 40 can be embedded in the bottom surface 11*a*1 of the concave portion 11*a* of the socket 10 using an insert-molding method. When the heat transfer portion 40 is embedded in the bottom surface 11*a*1 of the concave portion 11*a* using an insert-molding method, the heat transfer portion 40 can be in close contact with the socket 10. Accordingly, the heat is easily transferred between the heat transfer portion 40 and the socket 10.

However, when the vehicle luminaire 1 (the light-emitting element 22) is repeatedly turned on and off, the socket 10 and the heat transfer portion 40 are repeatedly heated and cooled. Since the materials are different, the linear expansion coefficient (thermal expansion amount) of the material of the socket 10 and the linear expansion coefficient (thermal expansion amount) of the material of the heat transfer portion 40 are different. Accordingly, when the heating and the cooling are repeated, a thermal stress is repeatedly generated. Therefore, a gap may be formed between the socket 10 and the heat transfer portion 40 over time due to the repeated thermal stress. When a gap is formed between the socket 10 and the heat transfer portion 40, there is a risk that the thermal conduction to the socket 10 may be degraded or a temperature distribution may be generated in the heat transfer portion 40 or the substrate 21. When the thermal conduction is degraded or the heat transfer portion 40 or the substrate 21 has a temperature distribution, there is a risk that an increase in temperature of the light-emitting element 22 cannot be suppressed.

In this case, when the heat transfer portion 40 is provided inside the concave portion 11*c* or on the bottom surface 11*a*1 of the concave portion 11*a* through the adhesive layer 41 or a layer including a thermal conduction grease, these layers serve as buffer layers. Further, when the adhesive layer 42 is provided between the heat transfer portion 40 and the substrate 21, the adhesive layer 42 serves as a buffer layer. Therefore, when the adhesive layer 41 or the layer including a thermal conductive grease and the adhesive layer 42 are provided, the above-described thermal stress can be relaxed and the vibration due to traveling can be reduced. However, when the heat transfer portion 40 is provided inside the concave portion 11*c* or on the bottom surface 11*a*1 of the concave portion 11*a* through the layer including a thermal conductive grease, the bonding strength between the heat transfer portion 40 and the socket 10 decreases.

Therefore, the heat transfer portion 40 is preferably bonded into the concave portion 11*c* or onto the bottom surface 11*a*1 of the concave portion 11*a*. In this case, when the heat transfer portion 40 is bonded into the concave portion 11*c*, it is more preferable in that the bonding strength between the socket 10 and the heat transfer portion 40 can be further increased or the positional deviation of the heat transfer portion 40 can be suppressed.

Here, when the rigidity of the resin included in the adhesive layer 41 and the resin included in the adhesive layer 42 is too large, thermal stress relaxation and vibration damping effects decrease. On the other hand, when the rigidity of the resin is too small, there is a risk that at least one of the adhesive layer 41 and the adhesive layer 42 may be peeled off or cracked when vibration or the like is applied thereto. When the adhesive layer 41 and the adhesive layer 42 are peeled off or cracked, there is a risk that thermal conduction may be hindered due to a gap or the heat transfer portion 40 or the substrate 21 may be separated due to vibration or the like.

According to the knowledge obtained by the present inventor, the resin included in the adhesive layer 41 and the adhesive layer 42 is preferably a silicone resin. The adhesive layer 41 and the adhesive layer 42 including a silicone resin that is more flexible than epoxy resin or the like can improve the thermal stress relaxation effect and the vibration damping effect. Further, it is possible to suppress the adhesive layer 41 and the adhesive layer 42 from being peeled off or cracked when a vibration or the like is applied thereto.

Figure 5A:
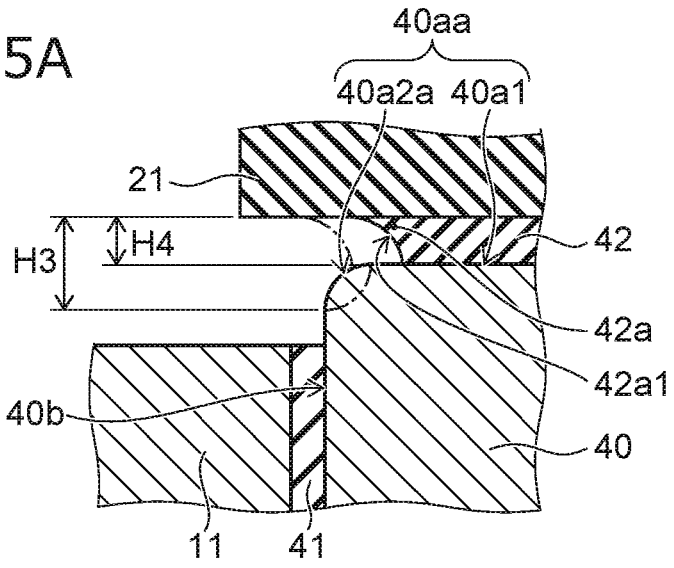
FIGS. 5A to 5C are schematic cross-sectional views illustrating a peripheral edge area according to another embodiment.
Figure 5B:
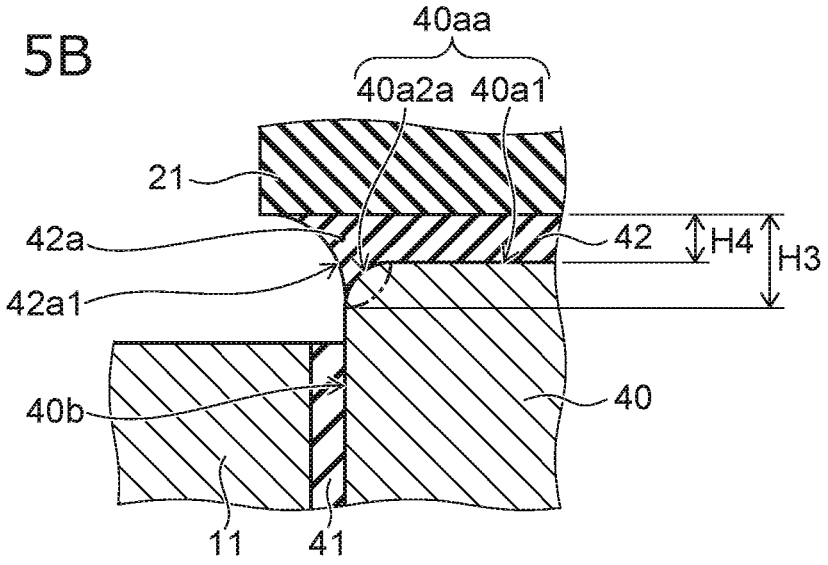
Figure 5C:
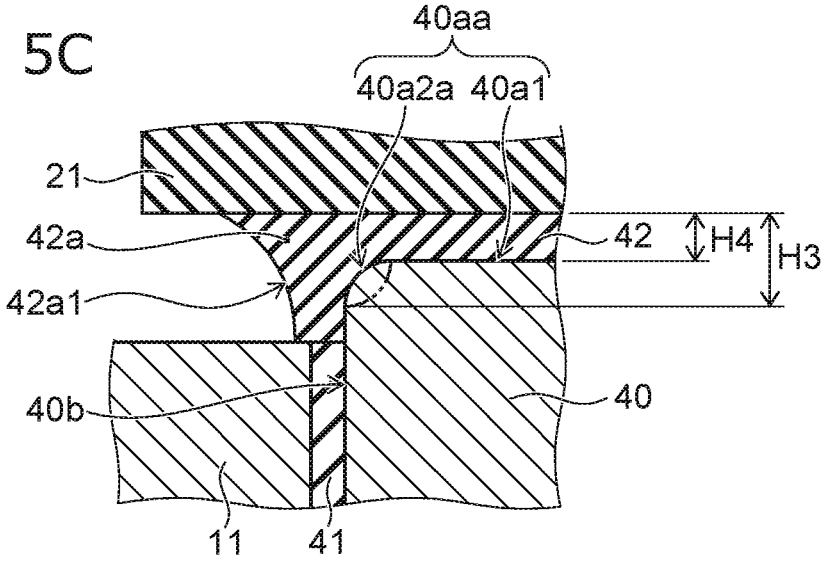

FIGS. 5A to 5C are schematic cross-sectional views illustrating a peripheral edge area 40*a*2*a* according to another embodiment.

As shown in FIGS. 5A to 5C, an area 40*aa* on the side of the substrate 21 in the heat transfer portion 40 can include a center area 40*a*1 and a peripheral edge area 40*a*2*a*.

At least a part of the peripheral edge area 40*a*2*a* can be provided with at least one of a convex curved surface and a concave curved surface. That is, the peripheral edge area 40*a*2 includes the flat inclined surface, but the peripheral edge area 40*a*2*a* includes at least one of the convex curved surface and the concave curved surface. For example, at least one of the convex curved surface and the concave curved surface can be provided in the entire area along the peripheral edge of the heat transfer portion 40 or a part of the area. A distance H3 between the substrate 21 and the end on the side opposite to the center area 40*a*1 (the side of the side surface 40*b* of the heat transfer portion 40) in a corresponding portion (a curved surface) of at least a part of the peripheral edge area 40*a*2*a* is larger than a distance H4 between the substrate 21 and the end on the side of the center area 40*a*1 in the corresponding portion.

Even in this configuration, the adhesive extruded to the peripheral edge area 40*a*2*a* is easily guided toward the bottom surface 11*a*1 of the concave portion 11*a*. Therefore, the adhesive more hardly enters the vicinity of the peripheral edge of the surface provided with the light-emitting element 22 in the substrate 21.

Figure 6:
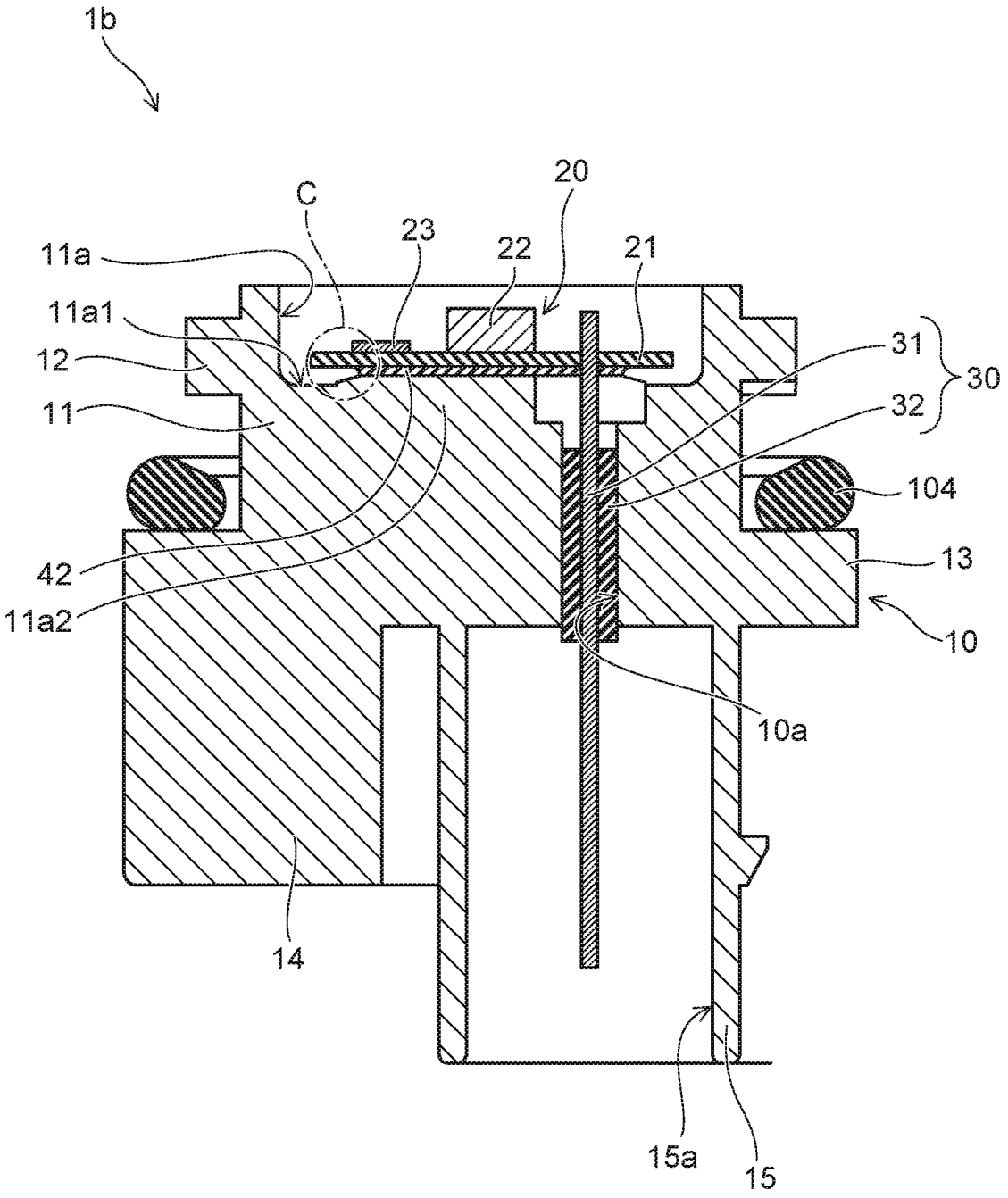
FIG. 6 is a schematic cross-sectional view illustrating a vehicle luminaire according to another embodiment.

FIG. 6 is a schematic cross-sectional view illustrating a vehicle luminaire 1*b* according to another embodiment.

Figure 7:
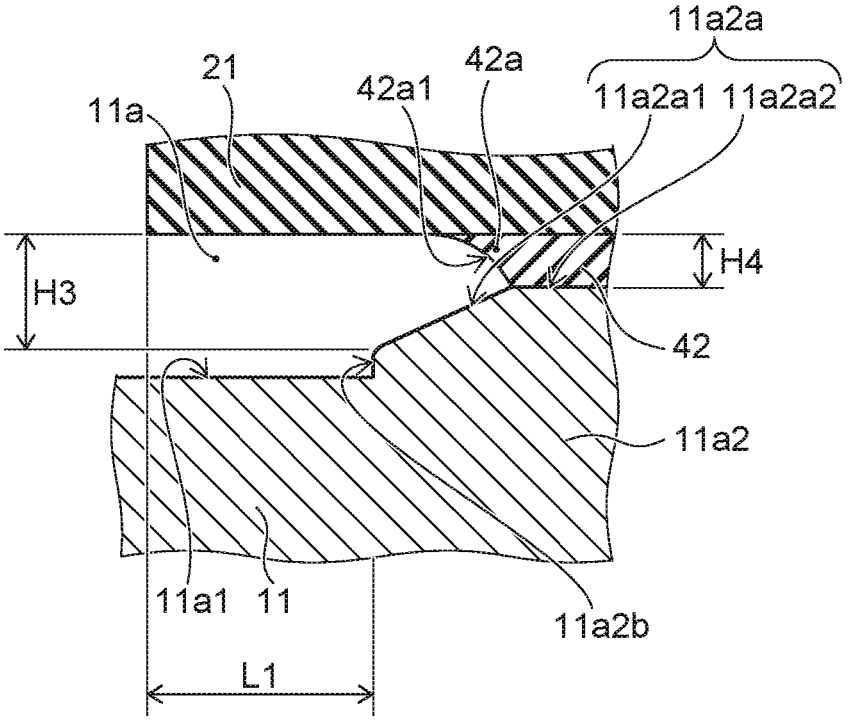
FIG. 7 is a schematic enlarged view of a C part of the vehicle luminaire of FIG. 6.

FIG. 7 is a schematic enlarged view of a C part of the vehicle luminaire 1*b* of FIG. 6.

As described above, when the heat transfer portion 40 is provided, heat generated in the light-emitting module 20 is easily transferred to the socket 10.

However, for example, the total luminous flux may be reduced depending on the application or the like of the vehicle luminaire. For example, when the total luminous flux may be small, heat generated in the light-emitting element 22 can be reduced. Therefore, the heat transfer portion 40 can be omitted depending on the application or the like of the vehicle luminaire. When the heat transfer portion 40 can be omitted, a decrease in weight or cost of the vehicle luminaire can be realized.

When the heat transfer portion 40 is omitted, a convex portion 11*a*2 can be provided in the bottom surface 11*a*1 of the concave portion 11*a* as shown in FIGS. 6 and 7. That is, the convex portion 11*a*2 can be provided at one end side of the socket 10. The convex portion 11*a*2 can be integrally formed with the socket 10 (the mounting portion 11).

The shape and the dimension of the convex portion 11*a*2 can be the same as, for example, the shape and the dimension of the portion protruding from the bottom surface 11*a*1 of the concave portion 11*a* in the heat transfer portion 40. Therefore, the peripheral edge of the substrate 21 is located on the outside of the peripheral edge of the convex portion 11*a*2 in plan view.

An area 11*a*2*a* on the side of the substrate 21 in the convex portion 11*a*2 can include a center area 11*a*2*a*1 and a peripheral edge area 11*a*2*a*2. The peripheral edge area 11*a*2*a*2 can be provided on the outside of the center area 11*a*2*a*1. For example, a distance between the substrate 21 and the end on the side opposite to the center area 11*a*2*a*1 (the side of the side surface 11*a*2*b* of the convex portion 11*a*2) in a corresponding portion of at least a part of the peripheral edge area 11*a*2*a*2 is larger than a distance between the substrate 21 and the end on the side of the center area 11*a*2*a*1 in the corresponding portion.

The center area 11*a*2*a*1 can be similar to the center area 40*a*1. The peripheral edge area 11*a*2*a*2 can be similar to the peripheral edge area 40*a*2 (40*a*2*a*). Therefore, the center area 11*a*2*a*1 and the peripheral edge area 11*a*2*a*2 will not be described in detail.

The light-emitting module 20 (the substrate 21) can be provided on the convex portion 11*a*2. The light-emitting module 20 (the substrate 21) can be bonded to the area 11*a*2*a* of the convex portion 11*a*2. The adhesive layer 42 can be provided between the substrate 21 and the convex portion 11*a*2. In this case, the surface roughness of the area 11*a*2*a* of the convex portion 11*a*2 is preferably 2 μm or more and 30 μm or less in terms of the arithmetic average roughness Ra. With such a configuration, since the bonding strength between the adhesive layer 42 and the convex portion 11*a*2 can be increased, the bonding strength between the substrate 21 and the socket 10 is easily increased.

At least one light-emitting element 22 is provided on the side opposite to the convex portion 11*a*2 in the substrate 21. Further, the distance L1 between the side surface 11*a*2*b* of the convex portion 11*a*2 and the end face of the substrate 21 (the protrusion dimension of the substrate 21 from the convex portion 11*a*2) is preferably 0.3 mm or more and 3.0 mm or less. With such a configuration, it is possible to suppress the adhesive from entering the vicinity of the peripheral edge of the surface provided with the light-emitting element 22 in the substrate 21 similarly to the case of the heat transfer portion 40. Further, when the peripheral edge of the substrate 21 protrudes from the side surface 11*a*2*b* of the convex portion 11*a*2, a claw of a chuck grasping the vicinity of the peripheral edge of the light-emitting module 20 (the substrate 21) can enter between the vicinity of the peripheral edge of the substrate 21 and the bottom surface 11*a*1 of the concave portion 11*a*. Therefore, the light-emitting module 20 (the substrate 21) is easily bonded to the convex portion 11*a*2 after the module is placed thereon using a transfer device having a chuck.

(Vehicle Lamp)

Next, the vehicle lamp 100 will be illustrated.

Hereinafter, a case in which the vehicle lamp 100 is a front combination light provided in an automobile will be described as an example. However, the vehicle lamp 100 is not limited to a front combination light provided in an automobile. The vehicle lamp 100 may be a vehicle lamp provided in an automobile or a rail car.

Figure 8:
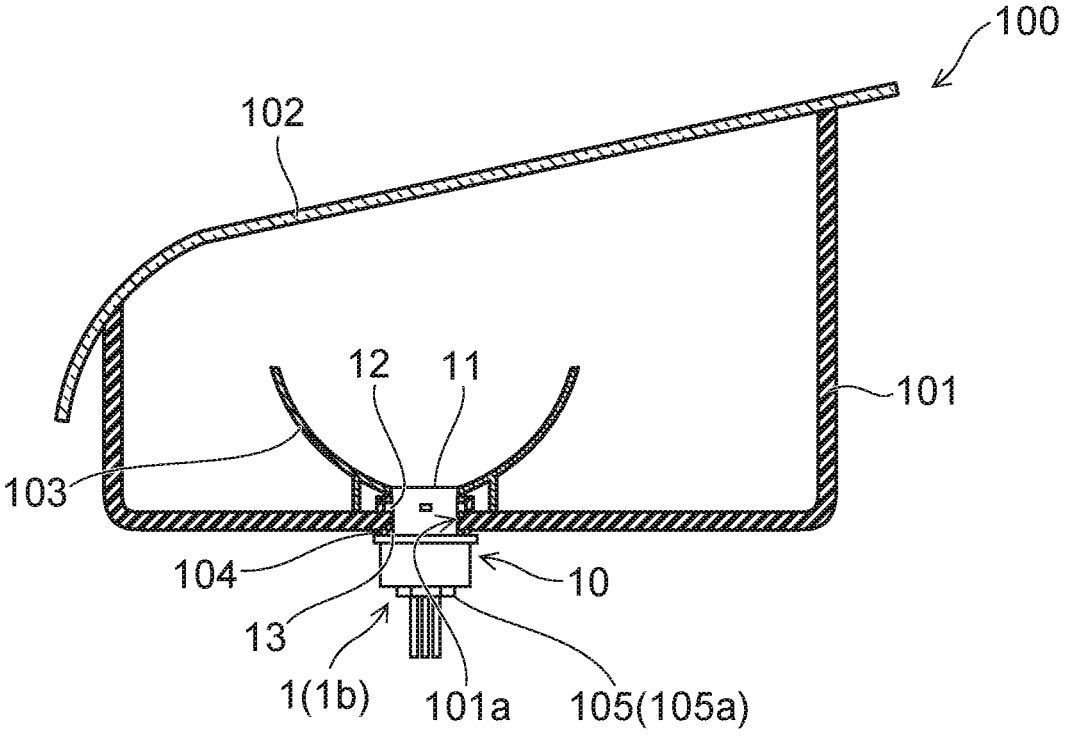
FIG. 8 is a schematic partially cross-sectional view illustrating a vehicle lamp.

FIG. 8 is a schematic partially cross-sectional view illustrating the vehicle lamp 100.

As shown in FIG. 8, the vehicle lamp 100 can be provided with the vehicle luminaire 1 (1*b*), the housing 101, a cover 102, an optical element 103, a seal member 104, and a connector 105.

The vehicle luminaire 1 (1*b*) can be attached to the housing 101. The housing 101 can hold the mounting portion 11. The housing 101 can have a box shape whose one end side is opened. The housing 101 can be formed of, for example, a resin or the like through which light is not transmitted. The bottom surface of the housing 101 can be provided with an attachment hole 101*a* into which a portion provided with the bayonet 12 in the mounting portion 11 is inserted. The circumferential edge of the attachment hole 101*a* can be provided with a concave portion into which the bayonet 12 provided in the mounting portion 11 is inserted. Additionally, a case in which the attachment hole 101*a* is directly provided in the housing 101 has been illustrated, but an attachment member having the attachment hole 101*a* may be provided in the housing 101.

When attaching the vehicle luminaire 1 (1*b*) to the vehicle lamp 100, a portion provided with the bayonet 12 in the mounting portion 11 is inserted into the attachment hole 101*a* and the vehicle luminaire 1 (1*b*) is rotated. Then, for example, the bayonet 12 is held by the fitting portion provided in the circumferential edge of the attachment hole 101*a*. Such an attachment method is called a twist lock.

The cover 102 can be provided to block the opening of the housing 101. The cover 102 can be formed of a resin or the like having a translucency. The cover 102 can have a function of a lens or the like.

Light emitted from the vehicle luminaire 1 (1*b*) is incident to the optical element 103. The optical element 103 can perform reflection, diffusion, light guiding, light collection, formation of a predetermined light distribution pattern, and the like of the light emitted from the vehicle luminaire 1 (1*b*). For example, the optical element 103 illustrated in FIG. 8 is a reflector. In this case, the optical element 103 can form a predetermined light distribution pattern by reflecting the light emitted from the vehicle luminaire 1 (1*b*).

The seal member 104 can be provided between the flange 13 and the housing 101. The seal member 104 can have an annular shape. The seal member 104 can be formed of an elastic material such as rubber or silicone resin.

When the vehicle luminaire 1 (1*b*) is attached to the vehicle lamp 100, the seal member 104 is sandwiched between the flange 13 and the housing 101. Therefore, the internal space of the housing 101 can be sealed by the seal member 104. Further, the bayonet 12 is pressed against the housing 101 by the elastic force of the seal member 104. Therefore, the separation of the vehicle luminaire 1 (1*b*) from the housing 101 can be suppressed.

The connector 105 can be fitted to the ends of the plurality of power-supply terminals 31 exposed inside the hole 10*b*. A power-supply (not shown) or the like can be electrically connected to the connector 105. Therefore, a power-supply (not shown) or the like can be electrically connected to the light-emitting element 22 by fitting the connector 105 to the ends of the plurality of power-supply terminals 31.

Further, the connector 105 can be provided with the seal member 105*a*. When the connector 105 having the seal member 105*a* is inserted into the hole 15*a* of the connector holder 15, the hole 15*a* is sealed so as to be watertight. The seal member 105*a* has an annular shape and can be formed of an elastic material such as rubber or silicone resin.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle luminaire comprising:

a socket;

a heat transfer portion or a convex portion which is provided at one end side of the socket;

a substrate which is provided on the heat transfer portion or the convex portion;

at least one light-emitting element which is provided on the side opposite to the heat transfer portion in the substrate or on the side opposite to the convex portion in the substrate; and a first adhesive layer which is provided between the substrate and the heat transfer portion or between the substrate and the convex portion, an area on the side of the substrate in the heat transfer portion or an area on the side of the substrate in the convex portion being provided with a center area and a peripheral edge area provided on the outside of the center area, and a distance between the substrate and an end on the side opposite to the center area in a corresponding portion in at least a part of the peripheral edge area being larger than a distance between the substrate and an end on the side of the center area in the corresponding portion.

2. The luminaire according to claim 1, wherein the center area includes a center of the area.

3. The luminaire according to claim 1, wherein the center area includes a flat surface.

4. The luminaire according to claim 3, wherein the flat surface is orthogonal to a center axis of the socket.

5. The luminaire according to claim 3, wherein the flat surface is parallel to a surface of the substrate.

6. The luminaire according to claim 3, wherein the center area further includes at least one of a concave portion and a convex portion.

7. The luminaire according to claim 1, wherein the peripheral edge area is a frame-shaped area surrounding the center area.

8. The luminaire according to claim 1, wherein the corresponding portion of the peripheral edge area is a surface inclined with respect to a surface of the substrate.

9. The luminaire according to claim 1, wherein the center area includes a flat surface, the corresponding portion of the peripheral edge area is a surface inclined with respect to a surface of the substrate, and an angle between the flat surface and the surface inclined with respect to the surface of the substrate is 135° or more and 179° or less.

10. The luminaire according to claim 1, wherein the corresponding portion of the peripheral edge area is at least one of a convex curved surface and a concave curved surface.

11. The luminaire according to claim 1, wherein a peripheral edge of the substrate is located on the outside of a peripheral edge of the heat transfer portion or a peripheral edge of the convex portion in plan view.

12. The luminaire according to claim 1, wherein a surface roughness of a surface on the side of the heat transfer portion in the substrate or a surface on the side of the convex portion in the substrate is 5 μm or more and 40 μm or less in terms of an arithmetic average roughness (Ra).

13. The luminaire according to claim 1, wherein the first adhesive layer includes a silicone resin and a filler, and the first adhesive layer has thermal conductivity of 0.5 W/(m·K) or more and 10 W/(m·K) or less.

14. The luminaire according to claim 13, wherein a fillet is provided in a peripheral edge of the first adhesive layer.

15. The luminaire according to claim 14, wherein the fillet has a concave curved surface.

16. The luminaire according to claim 1, wherein the socket includes a high thermal conductive resin.

17. The luminaire according to claim 1, wherein the heat transfer portion is provided inside a concave portion provided at one end of the socket.

18. The luminaire according to claim 17, further comprising:

a second adhesive layer which is provided between the heat transfer portion and an inner wall of the concave portion.

19. The luminaire according to claim 18, wherein the second adhesive layer includes a silicone resin and a filler, and the second adhesive layer has thermal conductivity of 0.5 W/(m·K) or more and 10 W/(m·K) or less.

20. A vehicle lamp comprising:

the vehicle luminaire according to claim 1; and a housing to which the vehicle luminaire is attached.

* * * * *